US007005979B2

(12) United States Patent
Haughawout et al.

(10) Patent No.: US 7,005,979 B2
(45) Date of Patent: Feb. 28, 2006

(54) SYSTEM AND METHOD FOR MONITORING REMOTE CONTROL TRANSMISSIONS

(75) Inventors: Joseph Lee Haughawout, Aliso Viejo, CA (US); Jeremy K. Black, Irvine, CA (US)

(73) Assignee: Universal Electronics Inc., Cypress, CA (US)

( * ) Notice: Subject to any disclaimer, the term of this patent is extended or adjusted under 35 U.S.C. 154(b) by 178 days.

(21) Appl. No.: 10/603,839

(22) Filed: Jun. 25, 2003

(65) Prior Publication Data

US 2004/0263349 A1 Dec. 30, 2004

(51) Int. Cl.
*G08B 1/08* (2006.01)

(52) U.S. Cl. ..... 340/539.1; 340/825.22; 340/825.72

(58) Field of Classification Search ..... 340/539.1, 340/825.72, 825.22, 825.69, 825.57, 825.56; 370/394

See application file for complete search history.

(56) References Cited

U.S. PATENT DOCUMENTS

| | | | | |
|---|---|---|---|---|
| 4,623,887 A | | 11/1986 | Welles, II | 340/825.57 |
| 4,703,359 A | * | 10/1987 | Rumbolt et al. | 348/734 |
| 4,959,810 A | | 9/1990 | Darbee et al. | 364/900 |
| 5,235,414 A | | 8/1993 | Cohen | 358/84 |
| 5,410,326 A | * | 4/1995 | Goldstein | 348/734 |
| 5,481,256 A | | 1/1996 | Darbee et al. | 340/825.56 |
| 5,614,906 A | | 3/1997 | Hayes et al. | 341/176 |
| 5,959,751 A | | 9/1999 | Darbee et al. | 359/148 |
| 6,014,092 A | | 1/2000 | Darbee et al. | 341/23 |
| 6,223,348 B1 | * | 4/2001 | Hayes et al. | 725/152 |
| 6,225,938 B1 | | 5/2001 | Hayes et al. | 341/176 |
| 6,496,927 B1 | | 12/2002 | McGrane et al. | 713/1 |
| 6,747,568 B1 | * | 6/2004 | Teskey | 340/825.72 |
| 2002/0140571 A1 | * | 10/2002 | Hayes et al. | 340/825.72 |

* cited by examiner

*Primary Examiner*—Phung T. Nguyen
(74) *Attorney, Agent, or Firm*—Gary R. Jarosik

(57) ABSTRACT

A remote control transmission monitoring system. A remote control has programming for transmitting a sequence of command codes and a command receiver has programming for determining if the transmission from the remote control included all of the command codes in the sequence of command codes. The programming further functions to generate a signal to cause corrective action to be taken and/or to notify a user that an unsuccessful transmission of the sequence of command codes occurred when the transmission from the remote control is determined to include less than all of the command codes in the sequence of command codes.

41 Claims, 6 Drawing Sheets

SYSTEM AND METHOD FOR MONITORING REMOTE CONTROL TRANSMISSIONS

BACKGROUND

The following relates generally to remote control systems and, more particularly, relates to a system and method for monitoring remote control transmissions.

Devices adapted to unobtrusively monitor the tuning of a home entertainment center are known in the art. For example, U.S. Pat. No. 5,235,414 describes a device adapted to work with the remote controls of the various appliances that comprise the home entertainment center. The device functions to receive a signal from the remote controls, determine which appliance was the intended target of the signal, send an infrared signal to the intended target appliance, and store tuning information. In this manner, the stored information may be retrieved at a later time and used to determine program ratings.

While the system described in U.S. Pat. No. 5,235,414 performs adequately when it is only desired to simply monitor the transmission of command codes to a home entertainment center, what is needed is a system that functions to provide an indication to a remote control user that one or more transmitted command codes were not properly received by the home entertainment center. In this regard, remote controls commonly provide for the transmission of a sequence of command codes in response to activation of a macro key, such as described in U.S. Pat. No. 5,959,751. By way of example, a macro can be used to transmit a sequence of command codes to power on all appliances of a home entertainment center, to access pay-per-view events via a set-top box, etc. However, owing to the length of typical command code sequences comprising a macro, it is not uncommon for one or more of the command codes within the sequence to fail to reach the home entertainment center. The failure to successfully transmit all of the command codes from the remote control to the home entertainment center may arise from the user pointing the remote control away from the home entertainment center, from the transmission being temporarily interrupted by a passing person, etc. Accordingly, it is desired to provide a system and method that functions to signal a remote control and/or inform a remote control user that a sequence of command codes was not properly received by the home entertainment center to, among other things, allow the remote control and/or user to ensure that the home entertainment center is placed into the desired state.

SUMMARY

In accordance with these needs and desires, a remote control transmission monitoring system is hereinafter described. Generally, the system receives a transmission from a remote control and determines if the transmission from the remote control includes a recognizable command code. When the transmission from the remote control is determined to not include a recognizable command code, a signal is generated to notify the remote control and/or a user that an unsuccessful transmission was received. More specifically, the system includes a command receiver that has programming for determining if the transmission from the remote control includes all of the command codes in a sequence of command codes.

A better understanding of the objects, advantages, features, properties and relationships of the subject system and method will be obtained from the following detailed description and accompanying drawings which set forth illustrative embodiments which are indicative of the various ways in which the principles of the system and method may be employed.

BRIEF DESCRIPTION OF THE DRAWINGS

For a better understanding of the system and method described hereinafter, reference may be had to preferred embodiments shown in the following drawings in which.

DETAILED DESCRIPTION

Figure 1:
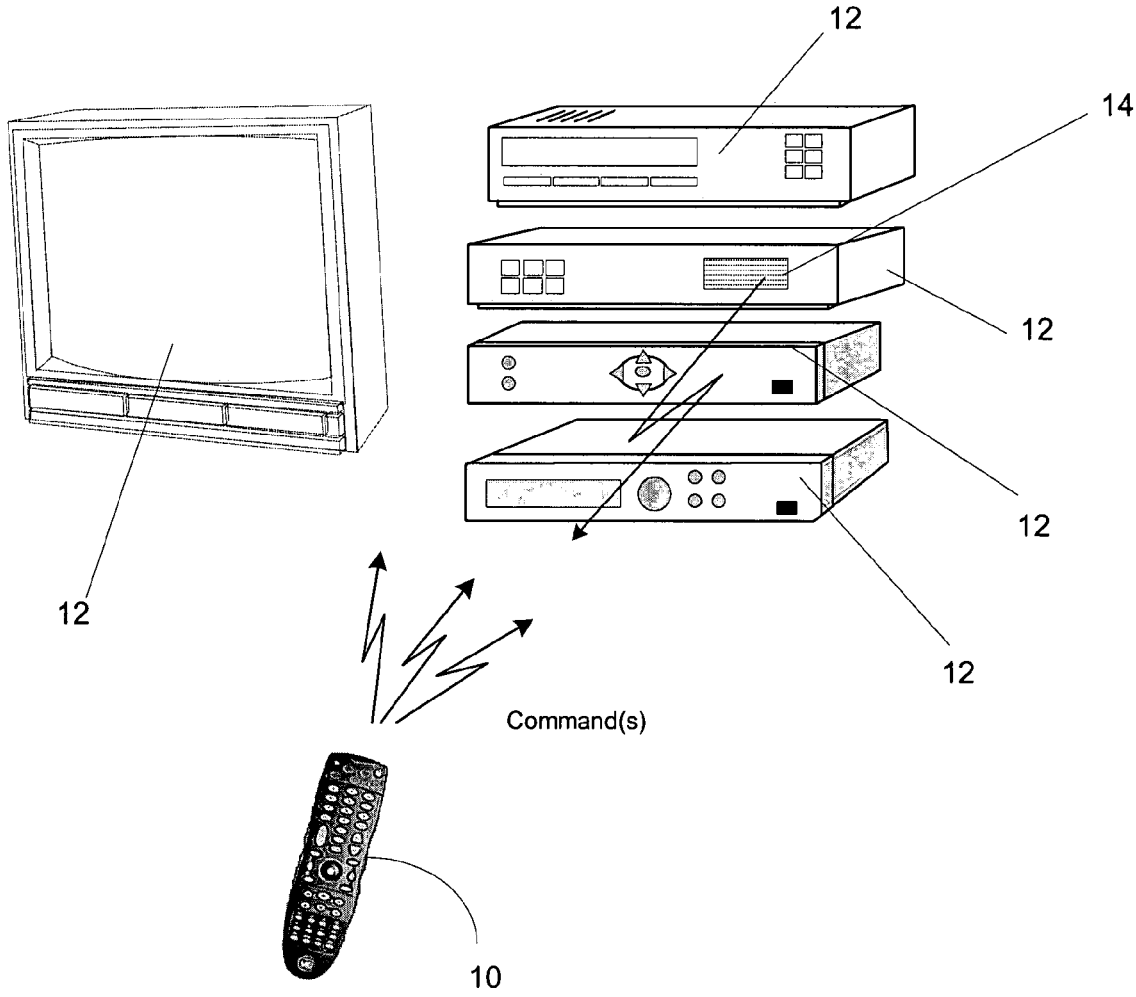
FIG. 1 illustrates an exemplary system employing a method for monitoring remote control transmissions.

With reference to the Figures, a system and method is described for use for monitoring remote control transmissions. To this end, the system generally includes a remote control 10 that is adapted to transmit command codes to control the operation of one or more home appliances 12 as is illustrated in FIG. 1. By way of example only, the appliances 12 can include, but are not limited to, televisions, VCRs, DVRs, DVD players, cable converter boxes, amplifiers, CD players, game consoles, home lighting, drapery, fans, HVAC systems, thermostats, personal computers, etc.

Figure 2:
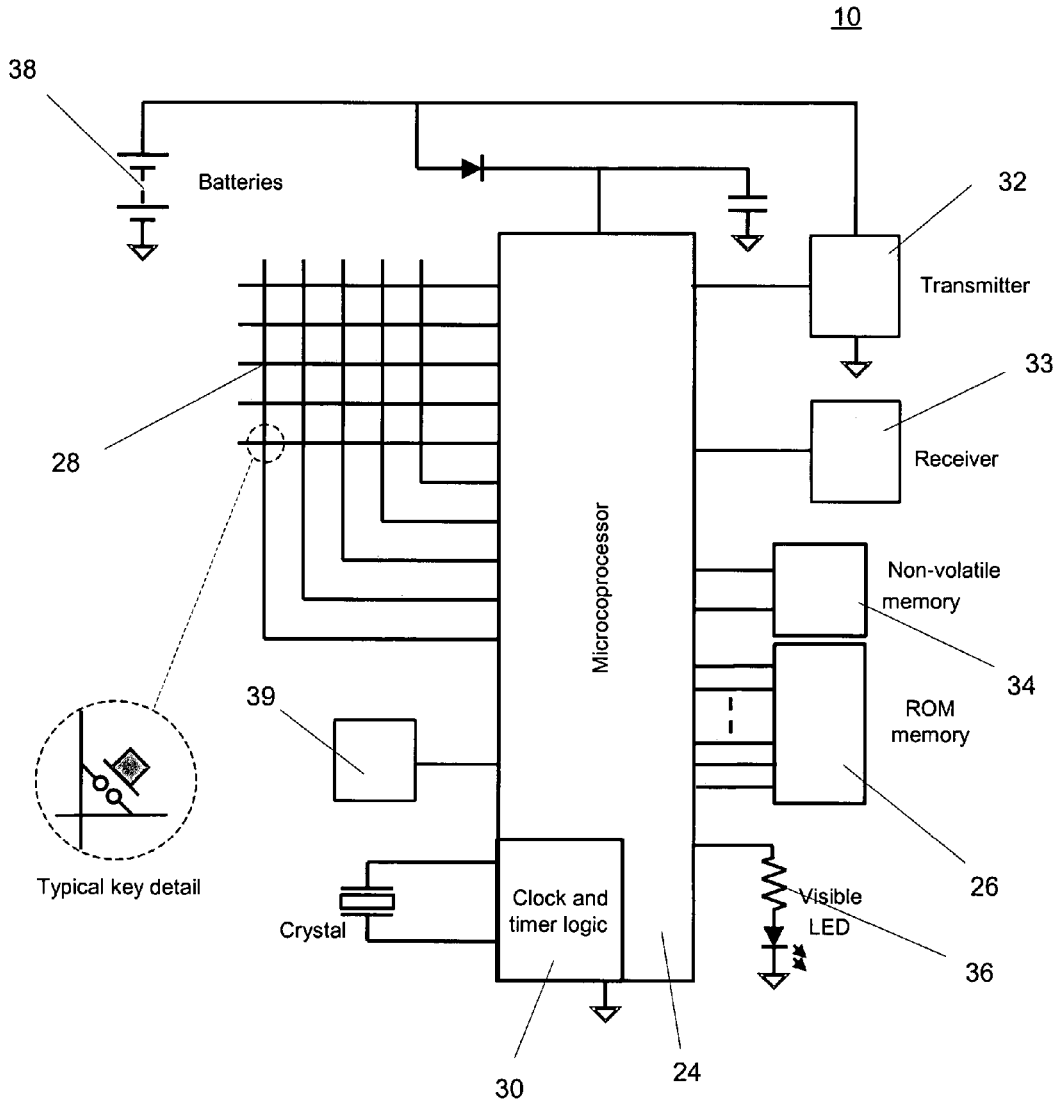
FIG. 2 illustrates a block diagram of components of an exemplary remote control.

For use in transmitting command codes to one or more of the appliances 12, the remote control 10 may include, as needed for a particular application, a processor 24 coupled to a ROM memory 26, a key matrix 28 (e.g., physical buttons, a touch screen display, or a combination thereof), an internal clock and timer 30, transmission circuit(s) 32, receiver circuit(s) 33 and/or transceiver circuit(s) (e.g., IR and/or RF), a non-volatile read/write memory 34, a means 36 to provide feedback to the user (e.g, LED, display, speaker, and/or the like), a power supply 38, and input means 39 (e.g., serial I/O port, wireless receiver, bar code scanner, etc.) as generally illustrated in FIG. 2. As will be understood by those of skill in the art, the ROM memory 26 may include executable instructions that are intended to be executed by the processor 24 to control the operation of the remote control 10. In this manner, the processor 24 may be programmed to control the various electronic components within the remote control 10, e.g., to monitor the power supply 38, to cause the transmission of signals, etc. The non-volatile read/write memory 34, for example an EEPROM, battery-backed up RAM, Smart Card, memory stick, or the like, may be provided to store setup data and parameters as necessary. While the memory 26 is illustrated and described as a ROM memory, memory 26 can also be comprised of any type of readable media, such as ROM, RAM, SRAM, FLASH, EEPROM, or the like. Preferably, the memory 26 is non-volatile or battery-backed such that data is not required to be reloaded after battery changes. In addition, the memories 26 and 34 may take the form of a chip, a hard disk, a magnetic disk, and/or an optical disk.

To identify home appliances by type and make (and sometimes model) such that the remote control device 10 is adapted to transmit recognizable command codes in the format appropriate for such identified appliances 12, data may be entered into the universal remote control device 10. Since methods for setting up a remote control to control the operation of specific home appliances are well-known, such methods need not be described in greater detail herein. Nevertheless, for additional information pertaining to remote control setup, the reader may turn to U.S. Pat. Nos. 4,959,810, 5,614,906, and 6,225,938. It will also be appreciated that the remote control 10 may be set up to control an appliance 12 by being taught the command codes needed to control such appliance as described in U.S. Pat. No. 4,623,887.

To cause the remote control 10 to perform an action, the remote control 10 is adapted to be responsive to events, such as a sensed user interaction with the key matrix 28, receipt of a transmission, etc. In response to an event appropriate instructions within the memory 26 may be executed. For example, when a command key is activated on the remote control 10, the remote control 10 may retrieve a command code corresponding to the activated command key from memory 26 and transmit the command code to a device in a format recognizable by the device. It will be appreciated that the instructions within the memory 26 can be used not only to cause the transmission of command codes and/or data to the appliances 12 but also to perform local operations. While not limiting, local operations that may be performed by the remote control 10 include displaying information/data, favorite channel setup, macro button setup, function key relocation, etc. Examples of local operations can be found in U.S. Pat. Nos. 5,481,256, 5,959,751, and 6,014,092. Additional examples of remote controls 10 may be found in commonly owned, U.S. Pat. No. 6,225,938 and U.S. application Ser. Nos. 60/264,767, 09/905,423, 09/905,432, and 09/905,396.

In keeping with the subject system and method, the remote control 10 preferably includes programming such that activation of a macro key causes the transmission of a sequence of command codes that have been assigned to the macro key. In the case where macros are user programmable, the macro programming will also allow a user to assign one or more command codes to the macro key. By way of example only, the assignment of command codes to the macro key may be made by the user interacting with the keys of the remote control 10 in the manner described in U.S. Pat. No. 5,959,751. Alternatively, the remote control can be preprogrammed to transmit one or more command codes in response to activation of the macro key. Still further, one or more command codes may be assigned to the macro key by means of being downloaded to the remote control, for example after an interactive session with a network site that maintains a database of command codes.

Figure 3:
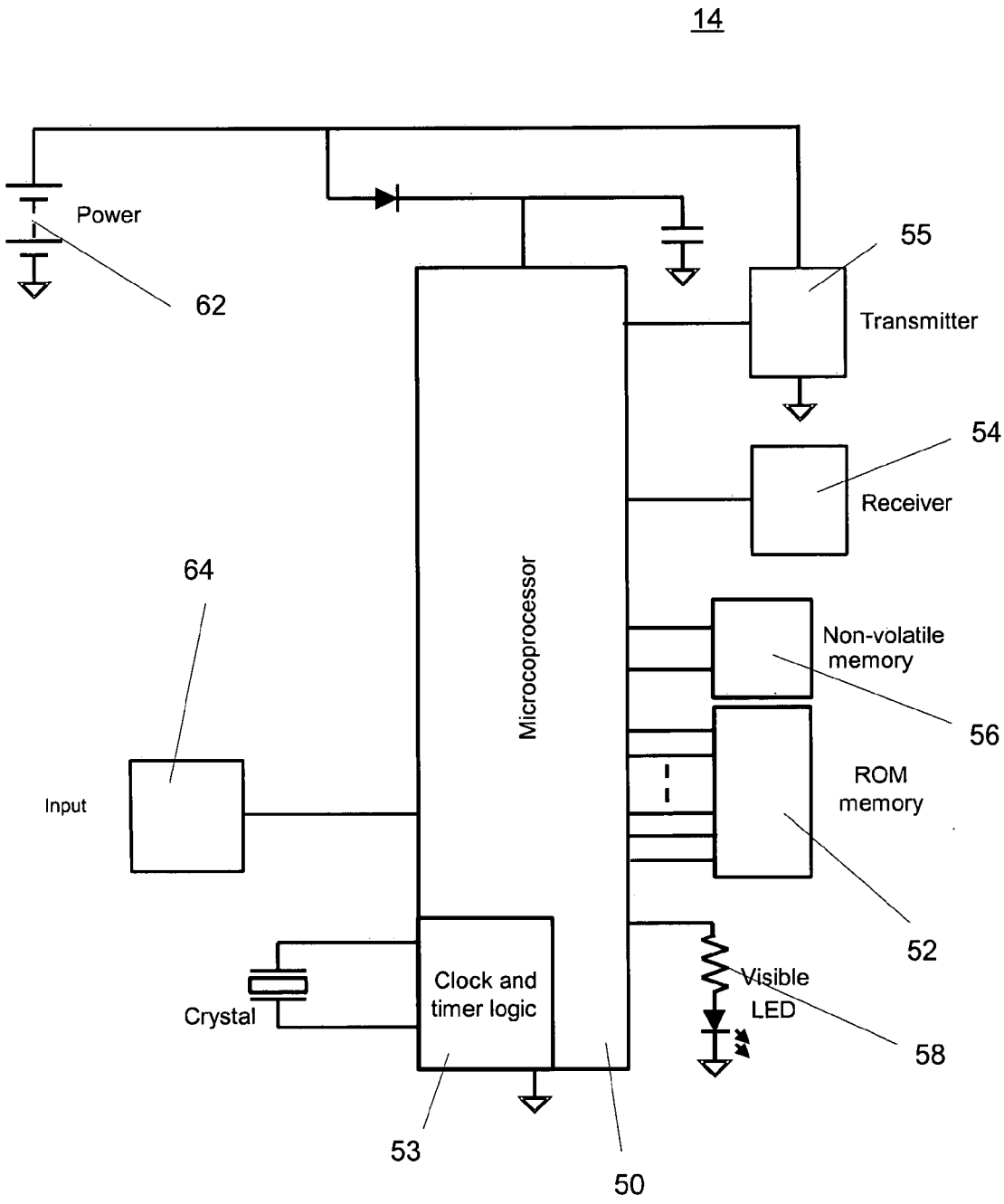
FIG. 3 illustrates a block diagram of components of an exemplary command receiver.

For use in monitoring for the successful transmission of command codes from the remote control 10 to one or more of the appliances 12, especially a sequence of command codes transmitted in response to activation of a macro key, the subject system and method includes a command receiver 14. The command receiver 14 may be a device separate and apart from the appliances 12 or may be integrated into one or more of the appliances 12 as is illustrated in FIG. 1. In either case, the command receiver 14 may include, as needed for a particular application, a processor 50 coupled to a ROM memory 52, an internal clock and timer 53, receiver circuit(s) 54, transmission circuit(s) 55 and/or transceiver circuit(s) (e.g., IR and/or RF), a non-volatile read/write memory 56, a means 58 to provide feedback to the user (e.g., LED, display, speaker, and/or the like), a power supply 62, and input means 64, (e.g., serial I/O port, wireless receiver, bar code scanner, etc.), as is generally illustrated in FIG. 3. The ROM memory 52 includes executable instructions that are intended to be executed by the processor 50 to control the operation of the command receiver 14. In this manner, the processor 50 may be programmed to control the various electronic components within the command receiver 14, e.g., to monitor the power supply 62, to cause the transmission of signals, to provide audio or visual prompts to a user, etc. The non-volatile read/write memory 56, for example an EEPROM, battery-backed up RAM, Smart Card, memory stick, or the like, is provided to store setup data and parameters as necessary. While the memory 52 is illustrated and described as a ROM memory, memory 52 can also be comprised of any type of readable media, such as ROM, RAM, SRAM, FLASH, EEPROM, or the like. Preferably, the memory 56 is non-volatile or battery-backed such that data is not required to be reloaded after battery changes. In addition, the memories 52 and 56 may take the form of a chip, a hard disk, a magnetic disk, and/or an optical disk. It will also be appreciated that in cases where command receiver capability is integrated into an appliance, some or all of the functional elements described above in conjunction with FIG. 3 may be combined with similar elements already present in the appliance for other purposes.

Figure 4:
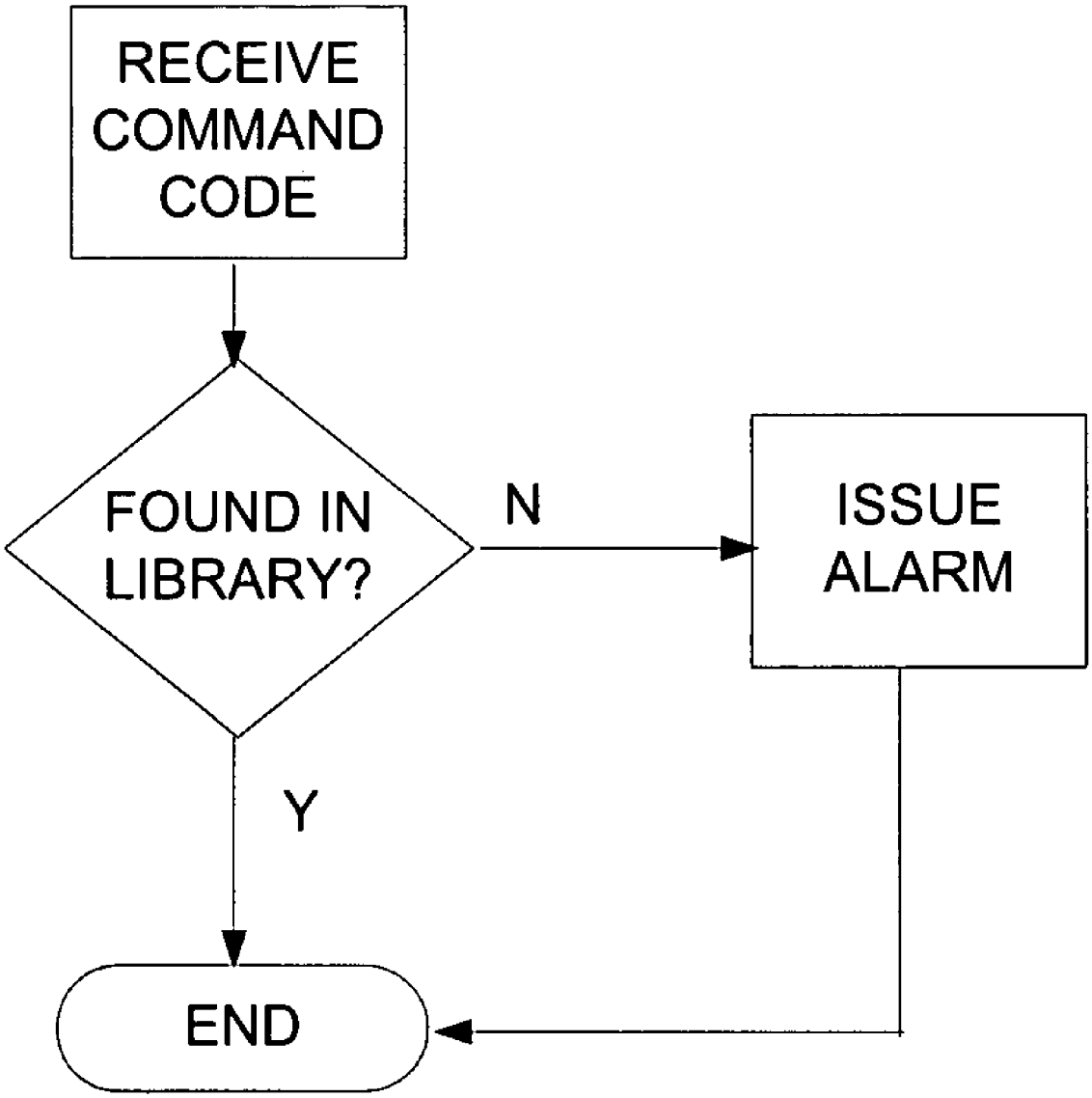
FIG. 4 illustrates a flow chart diagram of exemplary steps for use in monitoring for the successful transmission of a remote control command code.

As will be appreciated, especially in the case of IR transmissions, numerous activities may interrupt the transmission of command codes from the remote control 10 to the appliances 12. For example, a user may move the remote control such that an IR signal transmission is misdirected away from the appliances, an individual may walk in front of the remote control and inadvertently block an IR signal transmission, etc. Thus, as further illustrated in FIG. 4, the programming within the command receiver 14 preferably includes instructions for monitoring for the transmission of command codes by the remote control 10 and for determining, especially in the case of a macro where a plurality of commands are to be transmitted in sequence, if all of the command codes in the sequence were received by the command receiver 14.

For determining if a command code was properly received at the command receiver 14, a command code received by the receiver circuit(s) 54 may be compared against a library of command codes stored in the memory 52 or 56 of the command receiver 14. The library of command codes may be stored in the memory 52 or 56 at the time of manufacture and/or be downloaded into the command receiver which, for example, allows the library of command codes to be upgradeable. Downloading may be performed by means of wired or wireless connection and may include downloading the command codes via a network connection as described in U.S. Pat. No. 4,959,810, downloading the command codes via learning circuitry as described in U.S. Pat. No. 4,623,887, or the like.

In the case where the command receiver 14 is to evaluate the reception of a macro, i.e., a series of the command codes where the sequence may (or may not) be important to the operation of the intended target appliances, the command receiver 14 may additionally be programmed to recognize the sequence of command codes. To this end, the sequence of command codes that comprise a macro may be taught to the command receiver 14 in same manner as described in U.S. Pat. No. 4,623,887. More specifically, the command receiver 14 may be placed into a macro definition mode, the command codes that will comprise the macro may be transmitted to the command receiver 14 (for example, by the remote control 10), and the command receiver 14 may be caused to exit the macro definition mode as a means to inform the command receiver 14 that the entirety of the command sequence has been transmitted. It will be appreciated that the sequence of command codes that will comprise a macro may also be programmed into the command receiver 14 by interacting with a keypad (not illustrated) of the command receiver 14 in the same manner that would be used to program the remote control 10 to transmit the macro. Still further, the sequence of command codes that will comprise a macro may be downloaded into the command receiver 14 via a network connection (for example if the remote control macro is set up via interaction with a Web site—the same macro can be downloaded into the command receiver 14), by means of being read from a barcode, by being read from a smart card, etc.

Figure 6:
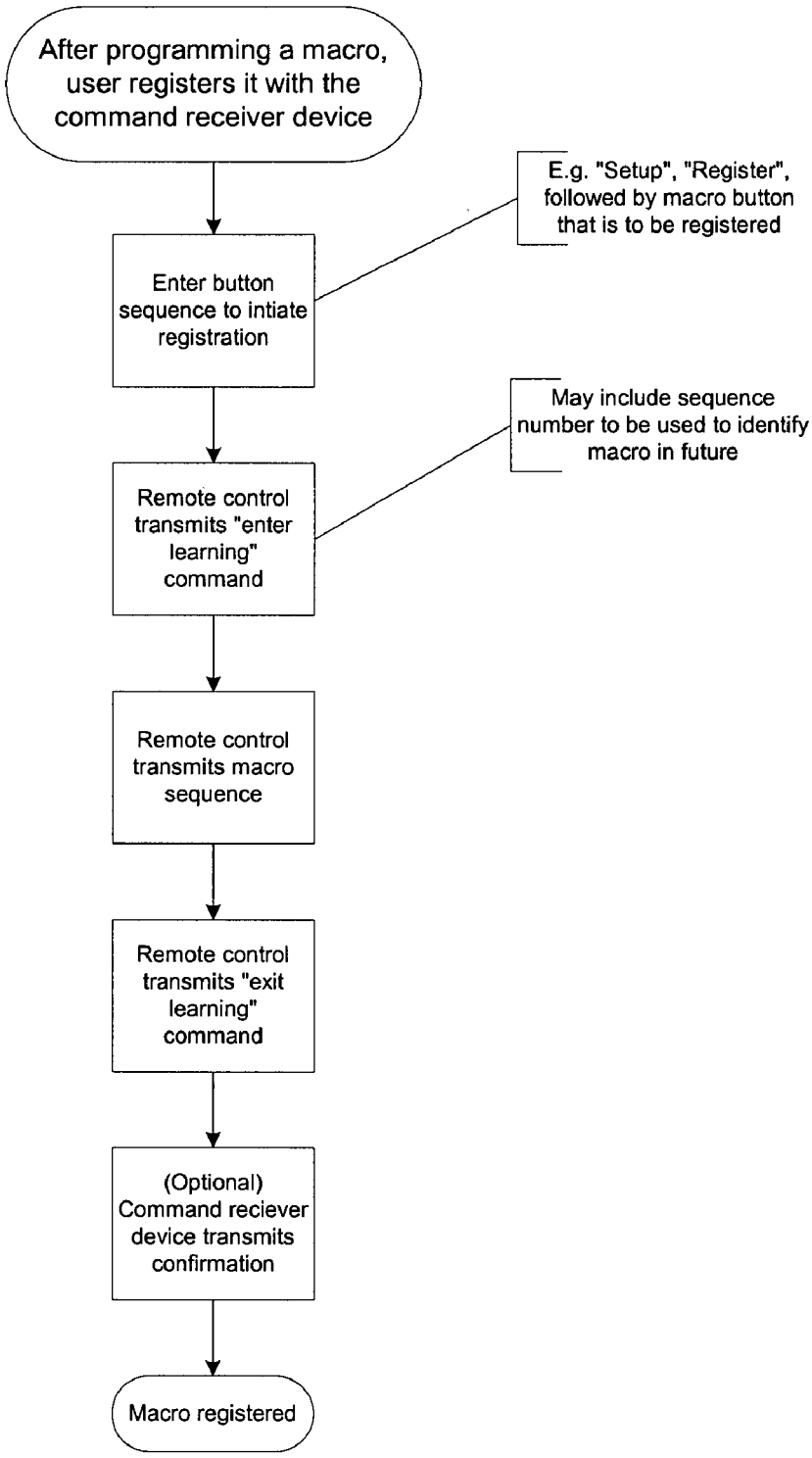
FIG. 6 illustrates a flow chart diagram of exemplary steps for registering a macro command code sequence with a command receiver.

By way of further example, the remote control 10 and command receiver 14 may be adapted to cooperate to facilitate the learning of command codes by the command receiver 14. To this end, with reference to FIG. 6, the remote control 10 may be adapted to respond to a user input that functions to signify a desire to request registration of a macro with the command receiver 14. In response to this user input, the remote control 10 may transmit a predefined "enter learning state" command to the command receiver 14 (e.g., using a standard infrared format recognizable by the command receiver 14) followed by the macro command code sequence to be taught to the command receiver 14. The end of the macro command code sequence may be signified by the remote control 10 transmitting an "exit learning state" command to the command receiver 14. It will be appreciated that the command receiver 14 should respond to the "exit learning state" command so as to stop the recording of transmissions from the remote control 10.

Once the command codes that are to be monitored by the command receiver 14 have been stored and made accessible to the command receiver 14, the command receiver 14 is capable of comparing received command codes to determine if one or more received command codes has a counterpart within the library command codes accessible to the command receiver 14. The command receiver 14 may be programmed to commence the monitoring of command codes in response to a receipt of a "start monitoring" command code. The "start monitoring" command code may, for example, be transmitted from the remote control 10 as a prefix to a command code sequence that is transmitted from the remote control 10 in response to activation of a macro key. In this manner, if a counterpart to the received command code is determined to be missing from the library of command codes, it may be assumed that the received command code was corrupted during transmission. In such a case, the command receiver 14 may issue an alarm, visible or audible, to inform the user that they should attempt to resend the command code.

In the case where the command receiver 14 receives a series of commands transmitted as a macro transmission from the remote control 10, the sequence of command codes received by the receiver circuit(s) 54 of the command receiver 14 may also be compared against one or more stored sequences of command codes made accessible to the command receiver 14. In this manner, if a sequence of command codes received by the receiver circuit(s) 54 of the command receiver 14 fails to be found in the stored sequence(s) of command codes made accessible to the command receiver 14, e.g., one or more command codes are missing from the received transmission, the command receiver 14 may issue an alarm to inform the user that they should attempt to resend the macro command sequence.

Figure 5:
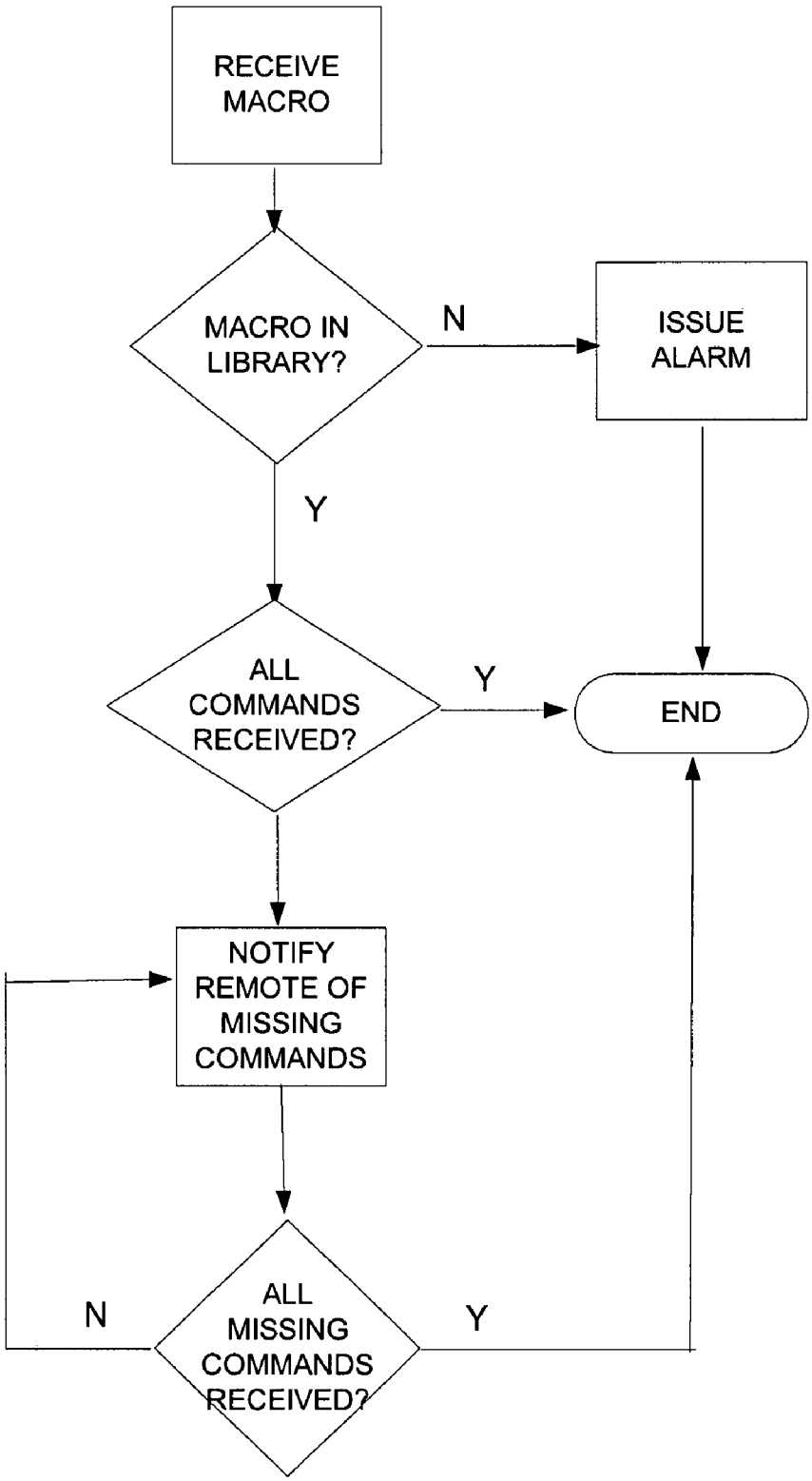
FIG. 5 illustrates a flow chart diagram of exemplary steps for use in monitoring for the successful transmission of a sequence of remote control command codes.

It may also be desirable to have the command receiver 14 notify the remote control 10 as to which command codes from a macro command code sequence were not properly received by the command receiver 14 to thereby allow for the retransmission of just those command codes. To this end, as illustrated in FIG. 5, the command receiver 14 may compare a received sequence of command codes against the macro command code sequences stored in memory, discern which macro stored in its memory is most likely to be the one that was intended to be transmitted by the remote control 10 (if more than one macro has been programmed into the command receiver 14), discern which command codes from that stored macro were not received, and issue a transmission (e.g., an event) to the remote control 10 that notifies the remote control 10 which commands were discerned to be missing from the intended macro transmission.

The transmission from the command receiver 14 to the remote control 10 may include data indicative of the missing command codes, e.g., a pointer into the memory of the remote control 10, or the missing command codes themselves. When the transmission includes the missing command codes, the command codes may be temporarily stored in the memory of the remote control 10 for easy retransmission back to the appliances 12. In either instance, it is preferred that the user be provided with an indication, such as a visible or audio alarm, that the remote control 10 has received a transmission from the command receiver 14 and is in a state for retransmitting command codes to the appliances 12, either using the received data or received command codes. The retransmission from the remote control 10 may be initiated by using a key that has been provided for that purpose, by activating the macro key again (in which case the remote control 10 would temporarily override the original programming of that macro key), etc. The command receiver 14 may additionally be programmed to look for the successful retransmission of those command codes that were previously determined to be missing. An appropriate timeout may be utilized in such a case to prevent the command receiver from becoming locked in a state where it is looking for the specific transmission of such command codes.

The system may also be configured such that the command receiver 14 is programmed to monitor the transmission of each command code as a sequence of command codes is received from the remote control 10. In this case, the command receiver 14 may confirm and acknowledge the receipt of that command code with the remote control 10. The remote control 10 may then wait for the acknowledgement before issuing the next command code in the sequence. If an acknowledgement is not received within a predetermined time, the remote control 10 may cause the command code from the sequence to be retransmitted.

In certain instances, it may also be desirable to provide labels to the macro transmissions to facilitate recognition of sequences of command codes by the command receiver 14. This would be particularly useful in the case where the command code sequence of one macro might be include as a subset of the command code sequence of another macro. To this end, the command receiver 14 may be taught a macro label by, for example, having the "enter learning state" command include a designator, e.g. a number, which has been assigned to the macro command code sequence to be learned by the command receiver 14. The designator assigned to a macro command sequence and included in the "enter learning state" command may be user programmable or may be, for example, pre-programmed by being representative of a key of the remote control 10 to which the macro command code sequence has been assigned. The command receiver 14 may then be informed of which command code sequence it is expected to receive by, for example, including the macro designator as part of a "start monitoring" command code transmitted from the remote control 10.

It may also be desired, in the case where the command receiver 14 is integrated within an appliance 12, to perform further steps whereby the command receiver 14 also functions to discern if all of the command codes of a macro intended to be transmitted from the remote control 10 were intended for the appliance 12 having the command receiver 14. If all of the command codes of the macro were intended for the appliance 12 having the command receiver 14, the appliance 12 may include a further feature that prohibits the appliance 12 from acting upon the received command codes until such time as the command receiver 14 discerns that all of the command codes in a macro were correctly and completely received. Alternatively, the appliance 12 may be programmed to simply perform all of the operations indicated by the command codes in a macro despite the fact that certain commands were not received, for example if a predetermined number of commands from a programmed macro are received by the command receiver 14.

It will be appreciated by those skilled in the art that the command receiver 14 need not be capable of completely decoding and understanding command codes that it receives. Rather, the command receiver 14 may only need to capture and store a representation of the transmissions received from the remote control 10 that would be sufficient to subsequently identify if the same transmission has been resent in the future by the remote control 10. Accordingly, differences in receiver bandwidth, response time, sampling interval, etc., between the command receiver hardware 54 and that of the other appliances for which signals are destined are not critical provided the detected and stored signal data is consistent and repeatable, i.e., the stored representation need not be an exact representation of the transmitted command code sequence.

For instance, it will be understood and appreciated by those skilled in the art that the remote control 10 of the present invention may be any portable control device (including but not limited to IR and/or RF based remotes, portable phones, wireless capable PDAs, etc) capable of transmitting and/or receiving command codes remotely to and from the command receiver 14. Likewise, the command receiver 14 of the present invention may be any home control device (including but not limited to STB's, media center PC's, home automation systems, etc) capable of receiving signals representing command codes from the portable control device, determining whether the complete set of command codes was received, and effectuating state changes in one or more appliances (either directly, or through further operation and interaction with the portable control device or other control devices).

While described in the context of monitoring command transmissions using a command receiver 12 associated with a home appliance, it will also be appreciated that a home control device, such as a personal computer, may also include instructions for performing, for example, the processes described as being performed by the command receiver 12. To this end, the home control device may comprise machine-readable instructions loaded in an accessible memory such as a hard disk drive or other non-volatile memory. Still further, the machine-readable instructions may be adapted to perform pre-programmed logic processing on an incoming command code set(s) such that an accurate determination of the completeness of the received command codes may be made without pre-configuring, learning, or otherwise notifying the home control device of the incoming command codes sets prior to receiving the command codes. The software to implement such a system is well within the routine skill of a programmer, and may include for instance, reference to a comparative database of command codes types, frequently used or desirable command code sets, determination of a particular command code scheme (such as a particular type of IR command encoding scheme), etc. It will also be appreciated that a combination of learned, programmed, or pre-loaded command codes sets used in conjunction with software based logic operations in the home control device may serve to further enhance the accuracy of determined missing command codes, while not necessarily requiring a user to program or teach every desired command code set to the home control device.

The home control device may also be connected to a network (such as a LAN, WAN, or the Internet) such that it may receive close range command codes (such as via an IR or RF base remote control) and/or long range command codes (such as from a remote user sending command codes from a portable phone, wireless enabled PDA, etc via the Internet), in each case the home control device being able to determine whether a complete set of command codes was received, and initiate a corrective measure via a signal back to the user and/or portable control device, or directly to the appliance(s) affected by the missing or incomplete command codes. By way of example, a remote user may send command codes (for instance representing commands to turn on the house lights and the home stereo) from a user interface on a wireless enabled PDA via the Internet to the home control device. The command codes may be any digital representation of the actual command codes to be sent the desired appliances, including a reference name or number indicating to the home control device the desired command codes. The home control device may then determine whether all command codes of the command code set were received properly (using the system and method as described above) and generates a signal to correct any missing or incomplete command codes. In cases where the home control device determines (generally through application of a software program or logic) that it cannot accurately recreate or determine the missing or incomplete command codes from a command code set, it may generate a signal to notify the portable control device and/or user to resend the command codes (either the entire command code set, selected missing command codes, or command codes for the portable control device to repeat back directly to one or more appliances). In each of these cases, the home control device may serve to relay desired command codes directly to various desired appliances to effectuate the desired functionality, or may relay one or more signals to a secondary signal relay/generation device (such as an IR repeater, RF wireless access point, etc) to effectuate the desired appliance functionality.

While various concepts have been described in detail, it will be appreciated by those skilled in the art that various modifications and alternatives to those concepts could be developed in light of the overall teachings of the disclosure. For example, while described in the context of functional modules and illustrated using block diagram format, it is to be understood that, unless otherwise stated to the contrary, one or more of the described functions and/or features may be integrated in a single physical device and/or a software module in a software product, or one or more functions and/or features may be implemented in separate physical devices or software modules. It will also be appreciated that a detailed discussion of the actual implementation of each module is not necessary for an enabling understanding of the invention. Rather, the actual implementation of such modules would be well within the routine skill of a programmer and system engineer, given the disclosure herein of the system attributes, functionality, and inter-relationship of the various functional modules in the system. Therefore, a person skilled in the art, applying ordinary skill, will be able to practice the invention set forth in the claims without undue experimentation. It will be additionally appreciated that the particular concepts disclosed are meant to be illustrative only and not limiting as to the scope of the invention which is to be given the full breadth of the appended claims and any equivalents thereof.

All patents cited within this document are hereby incorporated by reference in their entirety.

What is claimed is:

1. A method for monitoring for the successful transmission of a sequence of command codes transmitted from a remote control, the method comprising:

receiving a transmission from the remote control comprising at least a part of the sequence of command codes;

determining if the transmission from the remote control included all of the command codes in the sequence of command codes; and when the transmission from the remote control is determined to include less than all of the command codes in the sequence of command codes, performing an action for the purpose of initiating a retransmission of at least those command codes in the sequence of command codes determined to be missing.

2. The method as recited in claim 1, wherein the action comprises generating an audible signal.

3. The method as recited in claim 1, wherein the action comprises generating a visual signal.

4. The method as recited in claim 1, wherein the action comprises directly retransmitting at least those command codes in the sequence of command codes determined to be missing.

5. The method as recited in claim 1, wherein the action comprises sending a signal to the remote control to cause the remote control to retransmit at least those command codes in the sequence of command codes determined to be missing.

6. The method as recited in claim 5, wherein the signal comprises data indicative of command codes within the sequence of command codes determined to be missing from the sequence of command codes.

7. The method as recited in claim 5, wherein the signal comprises command codes within the sequence of command codes determined to be missing from the sequence of command codes.

8. The method as recited in claim 1, wherein the action comprises transmitting a signal to a secondary device to cause the secondary device to retransmit at least those command codes in the sequence of command codes determined to be missing.

9. A remote control transmission monitoring system, comprising:

a remote control having programming for transmitting a sequence of command codes; and a command receiver having programming for determining if the transmission from the remote control included all of the command codes in the sequence of command codes and for performing an action for the purpose of initiating a retransmission of at least those command codes in the sequence of command codes determined to be missing.

10. The system as recited in claim 9, wherein the action comprises generating an audible signal.

11. The system as recited in claim 9, wherein the action comprises generating a visual signal.

12. The system as recited in claim 9, wherein the action comprises transmitting a signal to the remote control to cause the remote control to retransmit at least those command codes in the sequence of command codes determined to be missing.

13. The system as recited in claim 12, wherein the signal comprises data indicative of command codes within the sequence of command codes determined to be missing from the sequence of command codes and the remote control has programming for using the data to retransmit the command codes within the sequence of command codes determined to be missing from the sequence of command codes.

14. The system as recited in claim 12, wherein the signal comprises command codes within the sequence of command codes determined to be missing from the sequence of command codes and the remote control has programming for retransmitting the command codes within the sequence of command codes determined to be missing from the sequence of command codes.

15. The system as recited in claim 9, wherein the command receiver is further adapted to learn the sequence of command codes directly from the remote control.

16. The system as recited in claim 9, wherein the command receiver is further adapted to communicate with a network whereby the sequence of command codes is downloadable into the command receiver.

17. The system as recited in claim 9, wherein the command receiver further includes a keypad for use in teaching the sequence of command codes to the command receiver.

18. The system as recited in claim 9, wherein the command receiver is integrated within a home appliance.

19. The system as recited in claim 9, wherein the command receiver is adapted to prevent the performance of operations of a home appliance corresponding to the sequence of command codes until such time as it is determined that all of the command codes within the sequence have been successfully received by the command receiver.

20. The system as recited in claim 9, wherein the command receiver is adapted to cause an appliance to perform all of the operations corresponding to the sequence of command codes when it is determined that the command receiver has received less than all of the command codes within the sequence.

21. The system as recited in claim 9, wherein the remote control and the command receiver communicate via a network.

22. The system as recited in claim 21, wherein the network comprises the Internet.

23. The method as recited in claim 22, wherein the action comprises generating an audible signal.

24. The method as recited in claim 22, wherein the action comprises transmitting a signal to the remote control to adapt the remote control to retransmit at least those command codes in the sequence of command codes determined to be missing.

25. A method for monitoring for the successful transmission of a command code transmitted from a remote control, the method comprising:

receiving a transmission from the remote control;

determining if the transmission from the remote control comprises a command code that is stored within a library of command codes; and when the transmission from the remote control is determined to not include a command code that is stored within the library of command codes, performing an action for the purpose of initiating a retransmission of at least those command codes in the sequence of command codes determined to be missing.

26. The method as recited in claim 25, wherein the action comprises generating an audible signal.

27. The system as recited in claim 26, wherein the remote control retransmits a command code if the acknowledgement is not received within a predetermined time.

28. A remote control transmission monitoring system, comprising:

a remote control for transmitting a sequence of command codes; and a command receiver for monitoring the transmission from the remote control;

wherein the command receiver is programmed such that, as each command code in the sequence is received from the remote control, the command receiver confirms and acknowledges the receipt of that command code with the remote control and wherein the remote control waits for the acknowledgement before transmitting the next command code in the sequence of command codes.

29. A method for programming a command receiver to monitor remote control transmissions, comprising:

receiving a transmission from the remote control to place the command receiver in a learning mode;

receiving a transmission from the remote control comprising a sequence of command codes;

storing a representation of the sequence of command codes within a memory accessible to the command receiver; and receiving a transmission from the remote control to exit the learning mode;

whereby the representation of the sequence of command codes is available to compare against future transmissions received from the remote control to determine if the future transmission from the remote control comprises the sequence of command codes.

30. The method as recited in claim 29, further comprising causing the command receiver to retransmit any command codes determined to be missing from a transmission received from the remote control.

31. The method as recited in claim 29, wherein a label is associated with the sequence of command codes transmitted by the remote control and the method further comprises the step of storing the label within the memory.

32. The method as recited in claim 31, wherein the transmission from the remote control to place the command receiver in a learning mode comprises the label.

33. A method for using a remote control to program a command receiver to monitor remote control transmissions, comprising:

transmitting from the remote control a command code to place the command receiver in a learning mode;

transmitting from the remote control a sequence of command codes where a representation of the sequence of command codes is stored within a memory accessible to the command receiver; and transmitting from the remote control a command code to cause the command receiver to exit the learning mode;

whereby the representation of the sequence of command codes stored in the memory is available to compare against future transmissions from the remote control to determine if the future transmission from the remote control comprises the sequence of command codes.

34. The method as recited in claim 33, wherein a label is associated with the sequence of command codes transmitted by the remote control and the method further comprises the step of transmitting the label from the remote control to the command receiver.

35. The method as recited in claim 34, wherein the transmission from the remote control to place the command receiver in a learning mode comprises the label.

36. The method as recited in claim 35, wherein the label is representative of a key of the remote control which, upon activation, causes the transmission of the sequence of command codes.

37. A remote control having instructions for programming a command receiver to monitor remote control transmissions, the instructions performing steps comprising:

transmitting a command code to place the command receiver in a learning mode;

transmitting a sequence of command codes to thereby allow a representation of the sequence of command codes to be stored within a memory accessible to the command receiver; and transmitting a command code to cause the command receiver to exit the learning mode;

whereby the representation of the sequence of command codes stored in the memory is available to compare against future transmissions from the remote control to determine if the future transmission from the remote control comprises the sequence of command codes.

38. The remote control as recited in claim 37, wherein a label is associated with the transmitted sequence of command codes and the instructions further comprise the step of transmitting the label to the command receiver.

39. The remote control as recited in claim 38, wherein the transmission to place the command receiver in a learning mode comprises the label.

40. The remote control as recited in claim 38, wherein the label is representative of a key of the remote control which, upon activation, causes the transmission of the sequence of command codes.

41. The remote control as recited in claim 40, wherein the instructions further provide for user programming of the sequence of command codes and assignment of the sequence of command codes to the key.

* * * * *